United States Patent [19]

Doss et al.

[11] Patent Number: 4,594,273

[45] Date of Patent: Jun. 10, 1986

[54] HIGH-RATE ELECTROLESS DEPOSITION PROCESS

[75] Inventors: Saad K. Doss, Gilroy; Peter B. P. Phipps, Saratoga, both of Calif.

[73] Assignee: International Business Machines Corporation, Armonk, N.Y.

[21] Appl. No.: 672,518

[22] Filed: Nov. 19, 1984

[51] Int. Cl.[4] ..... B05D 1/18

[52] U.S. Cl. ..... 427/443.1; 427/438

[58] Field of Search ..... 427/438, 443.1

[56] References Cited

U.S. PATENT DOCUMENTS 3,158,500 11/1964 Sallo et al. ..... 427/443.1 X

*Primary Examiner*—James R. Hoffman

*Attorney, Agent, or Firm*—Thomas R. Berthold

[57] ABSTRACT

The rate of deposition of metallic film on a substrate in an electroless plating process is substantially increased without affecting film properties or causing adverse consequences to the plating bath. The boiling point of the plating bath is elevated either by adding to the bath a substance, such as ethylene glycol, which does not alter the reactivity of the bath, or by providing a sealed enclosure over the bath to increase the ambient pressure. The bath is then heated to a substantially higher temperature but below the temperature at which localized boiling occurs. Excellent metal film qualities are obtained on the substrate at a substantially higher rate than in conventional electroless plating and no nucleation sites are created in the bath to cause spontaneous decomposition of the bath.

3 Claims, 2 Drawing Figures

HIGH-RATE ELECTROLESS DEPOSITION PROCESS

BACKGROUND OF THE INVENTION

This invention relates to the autocatalytic plating of metallic films on substrates, and in particular to an improved process for increasing the deposition rate of the films on the substrate without affecting the quality of the deposited films.

In autocatalytic plating (also referred to as electroless plating or deposition) a chemical reducing agent in solution reduces metallic ions to a metal which is deposited on a suitable substrate. The plating takes place only on "catalytic" surfaces rather than throughout the solution. The catalyst is initially the substrate, and subsequently the metal which is deposited on the substrate.

Electroless plating is a well known technique for the plating of nickel-phosphorus alloys. A typical plating bath for the electroless deposition of nickel-phosphorus includes a nickel salt, a reducing agent such as sodium hypophosphate ($NaH_2PO_2$), a complexing agent to help keep the nickel in solution and a compound which increases the stability of the bath. The deposition rate of nickel-phosphorus on the substrate is a function of, among other things, the pH and the operating temperature of the bath. While it is desired to operate the bath at as high a temperature as possible, localized boiling within the bath profoundly disrupts the transport of the nickel to the substrate, resulting in unacceptable film properties. In addition, localized boiling causes precipitation of nickel within the bath which can result in spontaneous decomposition. Certain types of materials (referred to as exaltants) increase the deposition rate without increasing the operating temperature of the bath. The mechanism by which they speed up deposition has not been explained completely.

A detailed description of electroless nickel-phosphorus deposition is found in *Symposium on Electroless Nickel Plating,* ASTM Special Technical Publication No. 265, 1959, and *Thin Film Processes,* Vossen, John L., Ed. and Kern, Werner, Ed., Academic Press, 1978, pp. 213–218.

SUMMARY OF THE INVENTION

The present invention is an improvement to the electroless deposition process, in particular to electroless plating of nickel-phosphorus, by increasing the operating temperature of the plating bath without affecting the properties of the deposited film and without causing spontaneous decomposition.

The plating rate is increased by altering either or both the bath composition and the atmosphere above the bath so that the reaction within the bath can occur at a temperature substantially higher, but without localized boiling and its adverse consequences. In one embodiment, a specific substance, such as ethylene glycol, which does not ionize to alter the reactivity of the bath solution or the effect of the complexing agent, is added to the bath. The substrate elevates the boiling point of the bath and thus permits the operating temperature of the bath to be substantially increased beyond the boiling point of the original solution, thereby increasing the deposition rate of the nickel-phosphorus on the substrate. Alternatively, the ambient pressure of the gas above the surface of the bath is increased, for example by providing a sealed enclosure over the bath. Since the vapor pressure above the solution is thus increased, the boiling point is elevated and deposition can be conducted at an increased rate.

In another embodiment of the improved process the container for the bath is surrounded by a liquid which is held in a second container and a substance is added to both the bath and the surrounding liquid. The substances are added to the bath and the surrounding liquid in amounts such that the boiling point of the surrounding liquid is lower than that of the bath. Both containers are provided with a sealed enclosure to increase the ambient pressure of the gas above the bath and the surrounding liquid. As the surrounding liquid cannot be heated beyond its boiling point the temperature of the bath is maintained at a relatively constant temperature below its boiling point, which has been elevated by the addition of the substance and by the increased ambient pressure of the gas above the bath surface.

For a fuller understanding of the nature and advantages of the present invention, reference should be made to the ensuing detailed description taken in conjunction with the accompanying drawings.

DESCRIPTION OF THE PREFERRED EMBODIMENTS

The nickel-phosphorous plating bath to which the improved process of this invention was applied consisted of 20% by volume of Niculoy 22M (7.2 grams per liter of nickel), 3.3% by volume of Niculoy 22S (38.6 grams per liter of $Na_2HPO_2$), and 76.7% distilled water. Niculoy 22M and 22S are proprietary bath solutions available from Shipley Company, Inc. and together include complexing and stabilizing agents. The pH of this bath is approximately 4.6 to 4.8 and the boiling point is 100.3° C. The conventional process for nickel plating with this bath solution includes heating the bath to 93.3° C. and periodically replenishing the bath in order to maintain the nickel concentration within a predetermined range. This process results in nickel plating at a rate of approximately 10 μm/hr.

Figure 1:
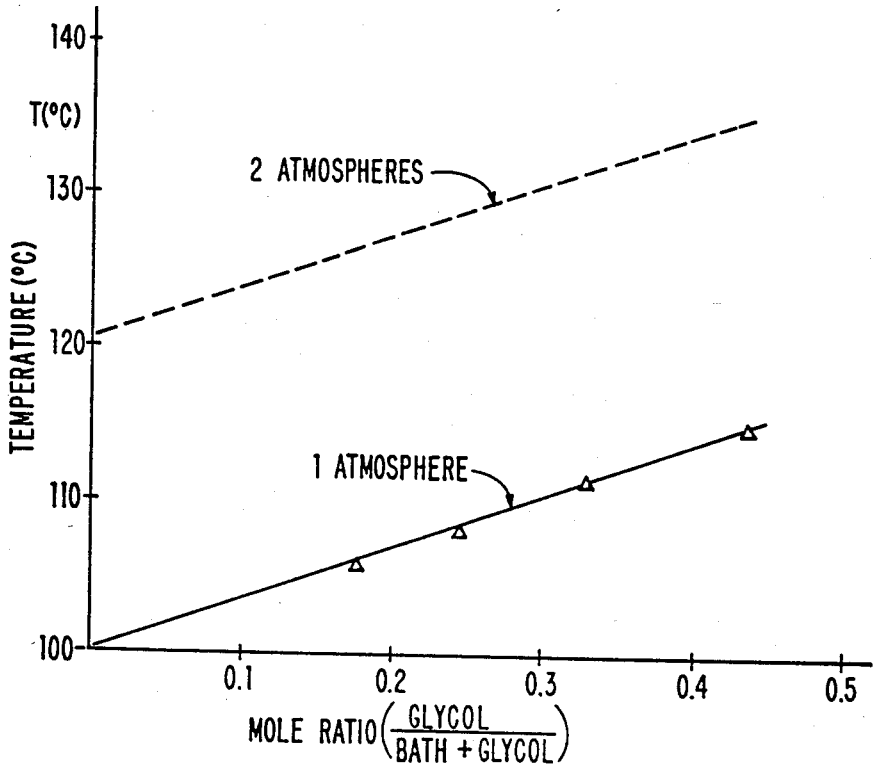
FIG. 1 is a graph illustrating the bath boiling point as a function of the amount of substance added to the plating bath and for different ambient pressures.

In one embodiment of the improved process, the above process was modified by adding ethylene glycol in various amounts and heating the solution to tempertures above 93.3° C. The solid line in FIG. 1 illustrates various bath temperatures as a function of the mole ratio of ethylene glycol to the total bath solution including the added ethylene glycol. For example, when ethylene glycol was added so that the new solution contained approximately 40% by volume of ethylene glycol, which constituted a mole ratio of 0.176, the boiling point of the solution was elevated to 105.5° C. The plating process occurred just below this temperature so that no localized boiling occurred. This resulted in a plating rate of approximately 15.6 μm/hr. The nickel films formed with the process utilizing the addition of ethylene glycol to the plating bath showed excellent quality. In addition, no precipitation of any nickel occurred within the solution. While ethylene glycol is a preferred substance to elevate the boiling point of the plating bath, other substances which do not alter the reactivity in the bath or produce any other adverse effect would function equally as well. For example, substances such as other glycols, sucrose, or glucose would also function to elevate the boiling point of the solution without adversely affecting the reactivity or other properties of the bath.

It is also possible to increase the deposition rate without adversely affecting film quality by increasing the ambient pressure of the gas over the surface of the plating bath. This has the effect of elevating the boiling point of the bath and thus permitting the plating bath to be operated at a higher temperature but below the temperature at which localized boiling occurs. The pressure is increased by providing a sealed enclosure over the surface of the bath. This can be used alone or in conjunction with the addition of ethylene glycol or other suitable substance to elevate the boiling point of the bath. The dotted line in FIG. 1 illustrates increased deposition rate and boiling points for various mole ratios of ethylene glycol to total bath solution when the ambient pressure over the surface of the gas was increased to two atmospheres.

Figure 2:
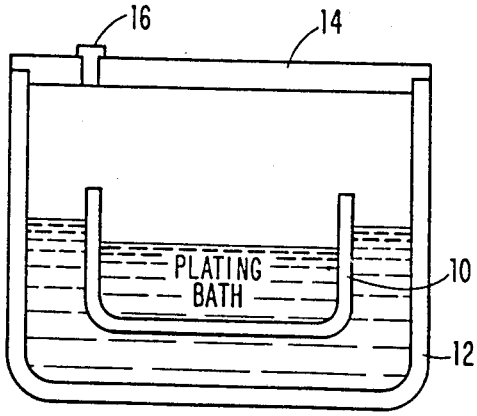
FIG. 2 is an illustration of the combination of a sealed enclosure and a liquid surrounding the plating bath to increase the deposition rate.

An embodiment of the present invention which utilizes both the addition of a boiling point elevating substance to the bath and increased ambient pressure over the bath surface is shown in FIG. 2. The plating bath containing ethylene glycol is held within container 10. A second container 12 holding water and ethylene glycol surrounds container 10 so that the liquid in container 12 surrounds the outside of container 10. A lid 14 having a safety pressure release value 16 provides a sealed cover for container 12. Ethylene glycol is added to the bath container 10 and to the water in container 12 in amounts so that the boiling point of the surrounding liquid in container 12 at the operating pressure is the desired operating temperature of the plating bath. Both the bath solution and the surrounding liquid are provided with a sealed enclosure, as shown by lid 14, which increases the ambient pressure over the bath and the surrounding liquid, thereby elevating the boiling point of both. The exterior of container 12 is then heated until the liquid in container 12 reaches its boiling point, at which point the bath is maintained at a constant temperature generally equal to the boiling point of the surrounding liquid in container 12. The surrounding liquid in container 12 also provides a generally even heat transfer to the plating bath. Since the atmosphere is composed of steam at a higher pressure than the vapor pressure of the bath, there is no loss of water from the bath and no creation of nickel salt crystals, which are a common source of nucleation sites for spontaneous decomposition of the bath, around the evaporating edge of the bath. The sealed enclosure keeps dust or undesirable particles out of the solution which could also serve as nucleation sites for spontaneous decomposition of the bath.

While the preferred embodiments of the present invention have been illustrated in detail, it should be apparent that modifications and adaptations to those embodiments will occur to those skilled in the art without departing from the spirit and scope of the present invention as set forth in the following claims.

What is claimed is:

1. In a process for the electroless deposition of a nickel-phosphorus alloy by contacting a suitable substrate with an aqueous solution containing nickel ions and hypophosphite ions while maintaining the solution at a predetermined process temperature, the solution for the electroless deposition of the nickel-phosphorus alloy being of the type wherein the rate of deposition of the alloy is substantially independent of the concentration of ions over a predetermined concentration range, an improvement comprising the steps of increasing the ambient pressure of the gas above the surface of the solution and heating the solution to a temperature higher than the previous predetermined process temperature but below the solution boiling point.

2. A process for the electroless plating of a film of nickel-phosphorus alloy on a substrate comprising the steps of:

preparing a plating bath which includes a nickel salt, sodium hypophosphite as a reducing agent, and a complexing agent;

adding a glycol to the plating bath in an amount such that the molar ratio of glycol to the total of bath and added glycol is within the range of approximately 0.18 to 0.43;

locating the substrate to be plated in the solution of bath and glycol; and heating the solution of bath and glycol to a temperature substantially close to but below the boiling point of the solution of bath and glycol until the nickel has been deposited on the substrate.

3. The process according to claim 2 further comprising the step of providing a substantially sealed enclosure over the surface of the solution of bath and glycol to increase the ambient pressure over the solution of bath and glycol.

* * * * *